US005178493A

United States Patent [19]

Vidal et al.

[11] Patent Number: 5,178,493

[45] Date of Patent: Jan. 12, 1993

[54] COUNTERFORT WALL

[75] Inventors: Henri Vidal, Neuilly-sur-Seine, France; Santiago Muelas-Madrano, Madrid, Spain; Longine J. Wojciechowski, Potomac, Md.

[73] Assignee: Societe Civile des Brevets de Henri Vidal, Puteaux Cedex, France

[21] Appl. No.: 885,258

[22] Filed: May 20, 1992

Related U.S. Application Data

[63] Continuation of Ser. No. 437,173, Nov. 16, 1989, abandoned.

[51] Int. Cl.[5] ..... E02D 29/02; E04B 1/38

[52] U.S. Cl. ..... 405/284; 52/403; 52/491; 52/512; 405/258; 405/262

[58] Field of Search ..... 405/284, 285, 286, 287, 405/258, 262, 272, 273, 277; 403/4, 7, 8, 199, 262, 403; 52/125.4, 125.5, 125.7, 125.12, 169.1, 169.8, 169.9, 295, 477, 480, 487, 491, 511, 512, 698, 699, 700, 701, 747, 403

[56] References Cited

U.S. PATENT DOCUMENTS

| | | | |
|---|---|---|---|
| 498,891 | 6/1893 | Thompson et al. | 52/125.4 |
| 2,066,006 | 12/1936 | Kellogg | 52/396 |
| 3,003,600 | 10/1961 | MacKenzie | 403/4 X |
| 3,574,510 | 4/1971 | Herman | 403/8 |
| 3,974,603 | 8/1976 | Vandegriff | 52/701 |
| 4,000,622 | 1/1977 | Chiaves | 52/169.1 |
| 4,469,466 | 9/1984 | Hotz | 403/262 X |
| 4,473,978 | 10/1984 | Wood | 52/169.8 |
| 4,643,618 | 2/1987 | Hilfiker et al. | 405/287 |
| 4,655,646 | 4/1987 | Babcock et al. | 405/286 |
| 4,817,353 | 4/1989 | Woods et al. | 52/295 |
| 4,911,585 | 3/1990 | Vidal et al. | 405/287 |
| 4,913,594 | 4/1990 | Sigourney | 405/285 |
| 4,961,673 | 10/1990 | Pagand et al. | 405/284 X |
| 4,982,550 | 1/1991 | Vidal et al. | 52/747 |

FOREIGN PATENT DOCUMENTS

| | | | |
|---|---|---|---|
| 733805 | 3/1943 | Fed. Rep. of Germany | 405/262 |
| 1811682 | 6/1970 | Fed. Rep. of Germany | 52/169.1 |
| 3602308 | 7/1987 | Fed. Rep. of Germany | 52/698 |
| 164515 | 8/1985 | Japan | 405/262 |
| 0310036 | 12/1989 | Japan | 52/698 |
| 585684 | 2/1947 | United Kingdom . | |
| WO84/04768 | 12/1984 | World Int. Prop. O. . | |

*Primary Examiner*—Michael Safavi

*Attorney, Agent, or Firm*—Burns, Doane, Swecker & Mathis

[57] ABSTRACT

A prefabricated concrete facing panel is connected to a prefabricated counterfort by way of a pair of bolted connections. Each connection includes a bolt projecting rearwardly from the panel and passing through a hole provided in a connecting arrangement of the counterfort, and a nut mounted on the threaded end of the bolt. The connection is not visible from the front of the facing. Both the facing panel and the counterfort are flat elements and are therefore easy to transport to the site.

12 Claims, 7 Drawing Sheets

COUNTERFORT WALL

This application is a continuation of application Ser. No. 07/437,173, filed Nov. 16, 1989 now abandoned.

FIELD OF THE INVENTION

The invention relates to a counterfort wall having a counterfort and a facing and a method of erecting such a wall.

BACKGROUND OF THE INVENTION

It is known to cast a concrete counterfort, or more usually a pair of counterforts, with steel reinforcement projecting therefrom, and then once the concrete has hardened a facing is cast to form an integral unit with the counterfort(s). The shuttering for the facing must be accurately positioned and while this is time consuming there are further delays in waiting for the concrete which forms the facing to harden and in removing the shuttering. Further, since a typical wall has a height of 1O m it is not usually practical for the casting to take place in the final position of use. Thus each counterfort is normally arranged horizontally while the facing is cast and eventually the whole unit which has considerable weight must be lifted to the vertical position by a crane. At this stage it has been found to be virtually impossible to avoid small knocks which chip away the concrete at any corners and edges and lead to cracks and other imperfections. If the damage is excessive it is sometimes necessary to discard the whole unit. However these problems have been thought to be unavoidable in view of the requirement to erect a sound structure in which the counterfort and the facing form an integral reinforced concrete unit.

OBJECTS AND SUMMARY OF THE INVENTION

We have now discovered that many of the problems of the prior art can be substantially eliminated by forming the facing by bolting one or more prefabricated facing panels to the counterfort(s).

Thus viewed from one aspect the invention provides a counterfort wall having a footing and prefabricated concrete elements which comprise at least one counterfort and at least one facing panel, the prefabricated concrete elements being secured together by at least one bolted connection, wherein one of the prefabricated elements has a bolt cast therein and projecting therefrom, and the other prefabricated element is provided with connecting means having a hole formed therein, the bolt extending through the hole in the connecting means, and fixing means being mounted on the free end of the bolt to form said at least one bolted joint which secures the prefabricated elements together.

Viewed from another aspect the invention provides a method of erecting a counterfort wall by providing a footing and mounting thereon prefabricated concrete elements comprising at least one counterfort and at least one facing panel, one of the prefabricated elements having a bolt cast therein and projecting therefrom, and the other prefabricated element being provided with connecting means having a hole formed therein, wherein the method further comprises securing together the prefabricated elements by placing said bolt through said hole and mounting fixing means on the free end of the bolt.

With such an arrangement the prefabricated panel or panels can be relatively quickly and accurately attached to the counterfort or counterforts on site, while the bolted connection or connections provide the required degree of strength and rigidity. Since the prefabricated elements can be relatively small and light they are easy to handle and maneuver during construction. In general, assembly on site takes less space than the casting method since no molds or shuttering are required and since the individual elements are all normally flat, transport is greatly facilitated as compared with monolithic counterfort wall units. Furthermore, if an element becomes chipped or otherwise damaged then it can be replaced without having to discard a large monolithic unit. To reduce the likelihood of damage, the elements will normally be prefabricated away from the site and will be protected from knocks during storage and transport by suitable packaging.

A further advantage is that a large number of identical panels can be prefabricated and used in walls of different height. Only a few of the panels, for example those used at the top of the structure, may need to be of different configuration. The panels may be provided with raised portions, grooves, striations, coloring or other markings so as to give the structure a striking or attractive appearance such as patterns when a plurality of panels make up the facing. A typical panel may be rectangular e.g. 2.0 m by 1.0 m and their abutting edges may be separated by a joint, such as foam or cork. The abutting edges may conveniently be keyed to provide an interlocking surface which may help to reduce water seepage, and will normally be covered with filter fabric to avoid loss of fines.

Normally, the facing panels will be bolted to at least two substantially parallel counterforts. It is preferred to use a plurality of panels attached to each counterfort, in order to reduce the weight of each individual panel. Thus in a preferred embodiment a plurality of facing panels are arranged one above the other and are each bolted to a pair of substantially parallel and laterally spaced counterforts. Two connections between each panel and each counterfort are normally sufficient. The structure will generally comprise a plurality of counterforts in a row.

The panels may be attached with the counterfort arranged horizontally, or the counterfort may be in the final, vertical position of use during attachment of the panels. In the latter case there is less weight to be lifted by a crane or otherwise to the vertical position. The use of scaffolding for attaching the panels can be avoided by backfilling each panel before attaching the panel above.

A preferred method comprises holding a pair of counterforts substantially parallel and laterally spaced from each other by spacer means, bolting a plurality of facing panels to the counterforts, and removing the spacer means. The spacer means might for example comprise a pair of spacer beams at lower and upper points on the counterforts. The spacer means is advantageously bolted to the counterforts using the hole or bolt thereof which subsequently serves to form the bolted connection with a facing panel. Preferably pairs of counterforts are successively mounted on the footing in a row, the spacer means of each such pair having locator means for connection to the spacer means of a previously mounted pair to ensure correct positioning relative thereto. The locator means may take the form of a vertical hole in the spacer means through which a lock pin in inserted to engage in a corresponding hole of the adjacent spacer means.

Plumbness of the counterfort in the forward and rear directions can be achieved by a brace extending between an upper region of the counterfort and a point on the site in front of the counterfort. The brace may be attached to the counterfort using the hole or bolt thereof which subsequently forms the bolted connection with a facing panel. Each counterfort may also be provided with an erection bolt extending downwardly from its base which may be adjusted to raise the counterfort so that the bolted connections of adjacent counterforts will be in a perfectly horizontal line.

The footing will normally be cast on site once any necessary excavation has been completed. A preferred method comprises casting a shear key, mounting the at least one counterfort on the shear key, and casting the footing to form a connection between the shear key and the at least one counterfort. Thus the shear key can serve as a levelling pad to support the prefabricated counterfort. Preferably the erection bolt of the counterfort is located at a front region thereof and engages the shear key, there being reinforcement projecting upwardly from the shear key and reinforcement projecting downwardly from a rear region of the counterfort, so that once adjustment of the position of the counterfort is complete the concrete footing may be cast to cover the erection bolt and the reinforcement to form an integral unit consisting of the shear key, the footing and the counterfort. In general, once the footing is sufficiently cured the lower spacer beam can be removed and attachment of the facing panels can begin. When panels have been attached to one third of the height of the counterfort, the brace and upper space beam may be removed.

There will preferably be resilient means, such as an elastic shim, disposed between the one prefabricated element and the connecting means of the other prefabricated element. This can help to prevent cracking or chipping caused by local surface roughness of one or both elements.

The counterfort may be provided with the bolt cast therein and projecting forwardly therefrom, the facing panel being formed with the hole, and the fixing means such as a nut being mounted on the bolt at the front of the panel. However, this results in the fixing means being exposed at the front of the structure and for architectural reasons this may not be desirable. Preferably therefore the bolt is cast in the facing panel and projects rearwardly therefrom. With such an arrangement, the bolted connection will not be visible on the facing of the structure. Furthermore, during construction it is necessary to mount the fixing means on each bolt and if the fixing means is located to the rear of the facing and backfilling takes place as each panel or row of panels is secured in position, operatives can then work by standing on the backfill, rather than using scaffolding or ladders at the front of the structure.

In one preferred embodiment in which the bolt projects rearwardly from the facing panel, the connecting means comprises a front portion of the counterfort through which the hole is formed, the hole ending in a recess accessible from the side to permit the fixing means to be mounted on the free end of the bolt. The recess will normally extend through the counterfort so that the free end of the bolt is accessible from both sides of the counterfort. In order to distribute the force of the fixing means on the front portion of the counterfort a metal e.g. steel plate may be provided between the fixing means and the hole in the front portion. Where the fixing means comprises a threaded nut, a washer will normally be provided in addition to the plate.

In another preferred embodiment in which the bolt projects rearwardly from the facing panel, the connecting means comprises a metal connector secured to the counterfort. Although the metal connector may take various forms, it preferably has two portions substantially perpendicular to each other, one of said portions having said hole formed therein and being secured to said facing panel by said bolted connection, and the other of said portions being secured to said counterfort by a second bolted connection. The second bolted connection may consist of a second bolt cast into the counterfort and projecting therefrom, but in a preferred arrangement the counterfort has a hole extending laterally therethrough, the second bolt passing through the hole and securing a pair of metal connectors to the counterfort, one on each side thereof, both the connectors being bolted to a respective facing panel. This arrangement provides a particularly secure connection between the counterfort and the panel and tends to prevent earth pressures acting on the facing from being transferred to the counterfort in an eccentric manner.

The holes in the two portions of the metal connector may be simple circular holes, but preferably the hole of said one portion is a vertical slot for permitting vertical adjustment of the facing panel on the counterfort, and the other portion has a horizontal slot for permitting horizontal adjustment of the facing panel on the counterfort. The vertical adjustment enables the panel to be lined up with an adjacent panel whilst the horizontal adjustment enables the panel to be moved perpendicular to the plane of the facing, again so it can be accurately positioned.

BRIEF DESCRIPTION OF THE DRAWINGS

Certain preferred embodiment of the invention will now be described by way of example and with reference to the accompanying drawings in which like elements bear like reference numerals and wherein.

DETAILED DESCRIPTION OF THE PREFERRED EMBODIMENTS

Figure 1:
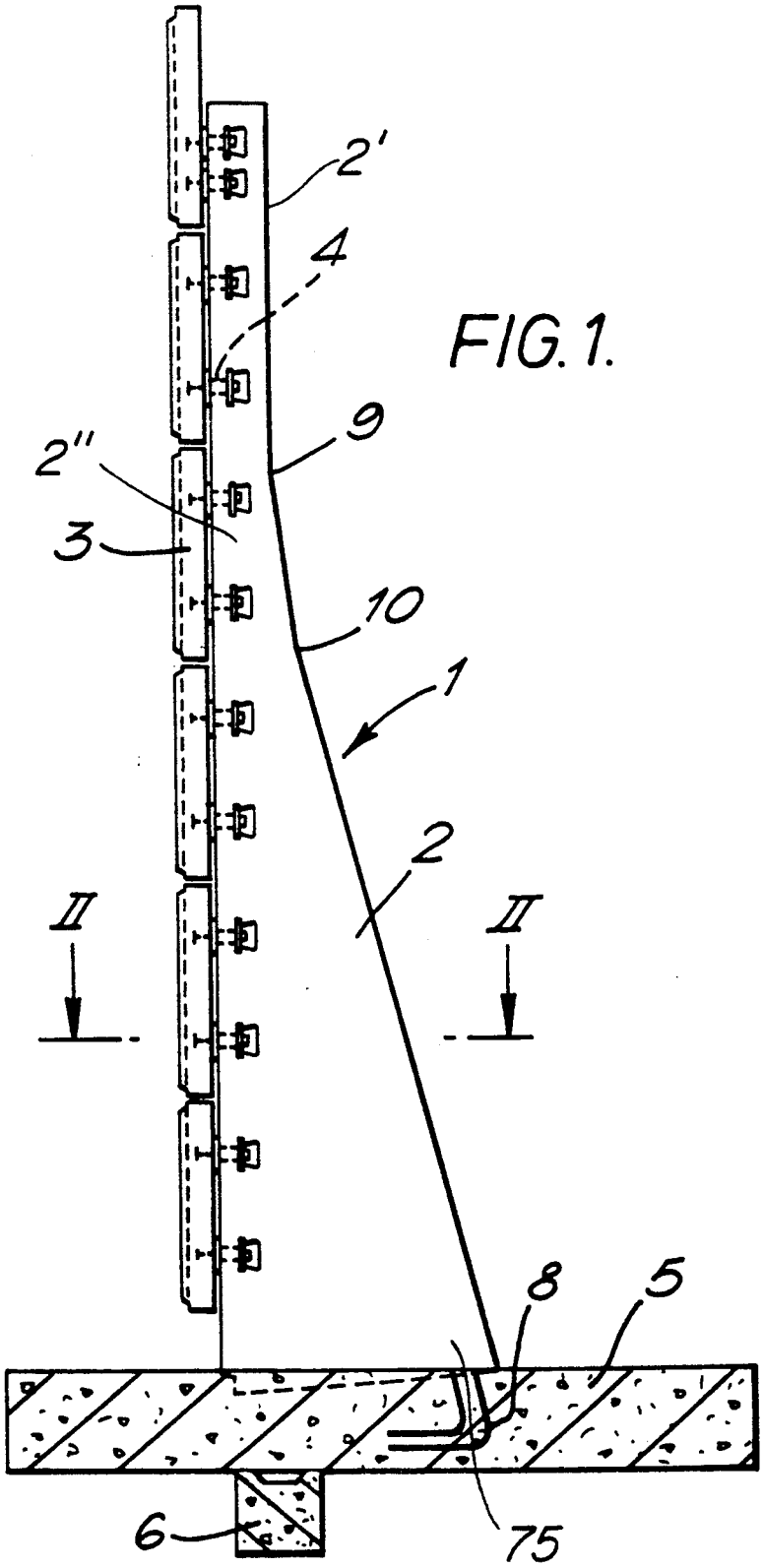
FIG. 1 shows a side elevation, partly in section, of a structure comprising a counterfort wall having a plurality of panels connected to counterfort.

Referring to FIG. 1, the counterfort wall 1 comprises a counterfort 2 to which a plurality of facing panels 3 are attached by bolted connections 4, and a footing 5 for supporting the wall. The footing rests on a shear key 6 which is also engaged by an erection bolt 7 (see FIGS. 7 to 10) which is embedded in the cast-in-place concrete footing 5. Steel reinforcement 8 projects downwardly from a rear portion 75 of the counterfort and is likewise embedded in the footing. The rear face 2' of the counterfort includes a pair of bends 9 and 10 to reduce the amount of concrete used in the upper portion 2'' of the counterfort where bending moments will be least.

Figure 2:
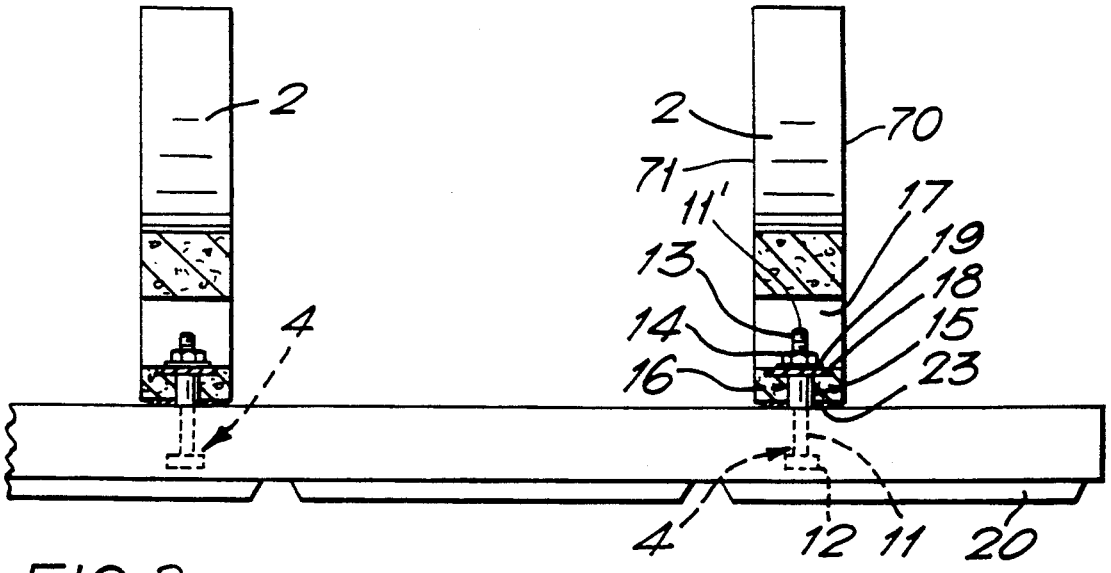
FIG. 2 shows a horizontal section on the lines II—II of FIG. 1.
Figure 3:
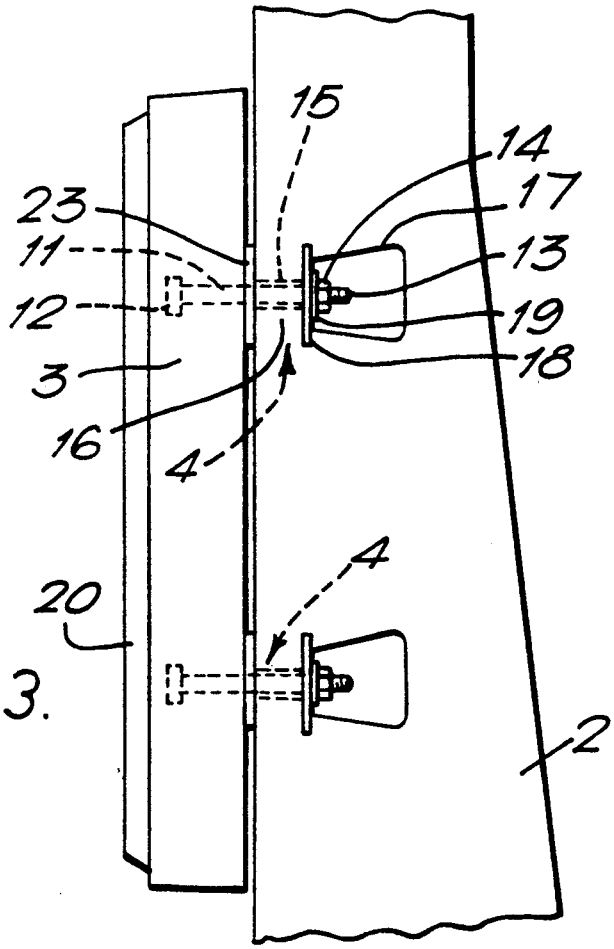
FIG. 3 is a view similar to FIG. 1 but to a larger scale showing further details of the bolted connections between a panel and the counterfort.

FIGS. 2 and 3 show in detail the bolted connections 4 between a pair of counterforts 2 and a panel 3. A bolt 11 has a head portion 12 which is precast into the facing panel and projects rearwardly therefrom, having at its free end 11' a threaded portion 13 engaged by fixing means which may be, for example, in the form of a nut 14. A correcting means can be provided for connecting the bolt 11 to the counterfort 2. In one embodiment, the connecting means can include a front portion 16 of the counterfort 2 which is provided with a recess 17. The bolt 11 passes through a hole 15 formed in the front portion 16 of the counterfort and extends into the recess 17 which is open to both sides 70,71 of the counterfort. A steel plate 18 is provided at the rear end of the hole 15 and is engaged by a washer 19 secured by the nut 14. A resilient means for providing resiliency between the panel 3 and the counterfort 2 can take the form of an elastic shim 23 is disposed between the facing panel and the front portion 16 of the counterfort.

A pair of counterforts are laterally spaced from each other and each is bolted to the facing panel 3 by a pair of vertically spaced connections 4. The panel 3 has a raised surface 20 to provide a decorative finish which tends to conceal the vertical and horizontal joints between adjacent panels (see FIG. 10).

Figure 4:
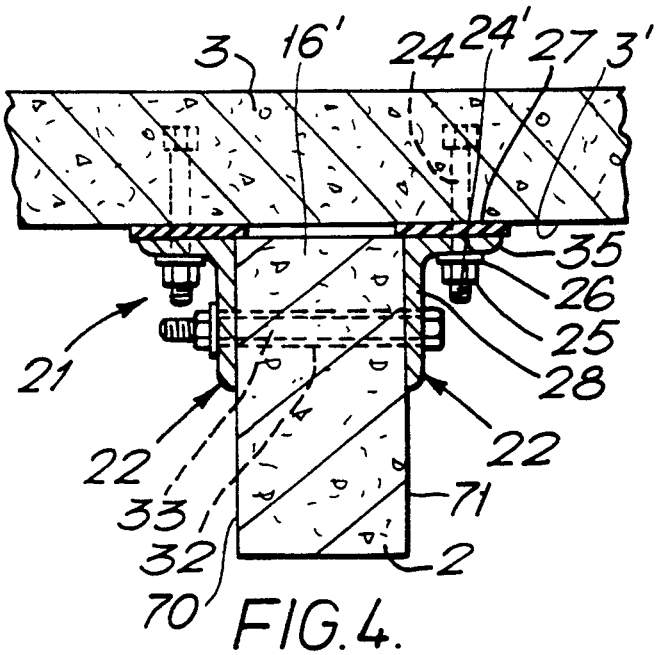
FIG. 4 shows a horizontal section through an alternative form of connection between a panel and a counterfort in which a metal connector is used.

An alternative form of bolted connection 21 is shown in FIG. 4. In this embodiment, the connecting means for connecting the bolt 24 which is cast in the facing panel 3 to the counterfort 2 can include a metal connector in the form of a clip angle 22 is bolted to one side face 70 of the front portion 16' of the counterfort 2. The clip angle has a first portion 35 having a vertically extending slot 36 through which the bolt 24 cast into and projecting rearwardly from the facing panel 3 extends. Fixing means in the form of a nut 25 can be provided, together with a washer 26, on the free end 24' of the bolt 24. The clip angle has a second portion 28 perpendicular to the first portion 35 and formed with a horizontal slot 31. The front portion 16' of the counterfort is provided with a laterally extending hole 32 through which a second bolt 33 extends to secure the clip angle to the counterfort. On the opposite side face 71 of the counterfort a second clip angle 22 is provided and is also secured to the counterfort by the bolt 33. The other features of the connection provided by the second clip angle correspond to those described in relation to the first clip angle.

Figure 5:
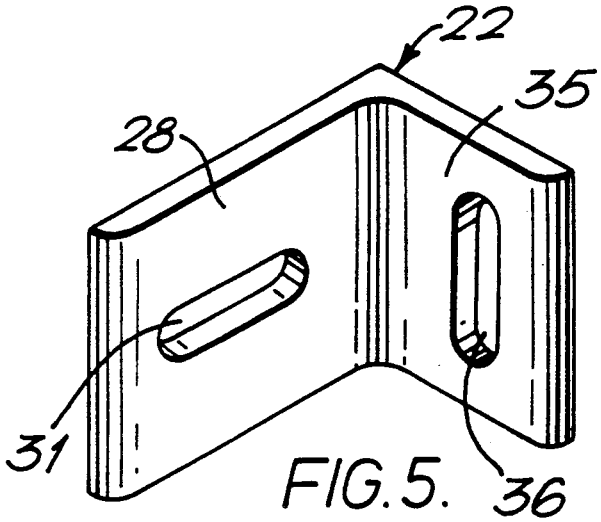
FIG. 5 is a perspective view of the metal connector shown in FIG. 4.
Figure 6:
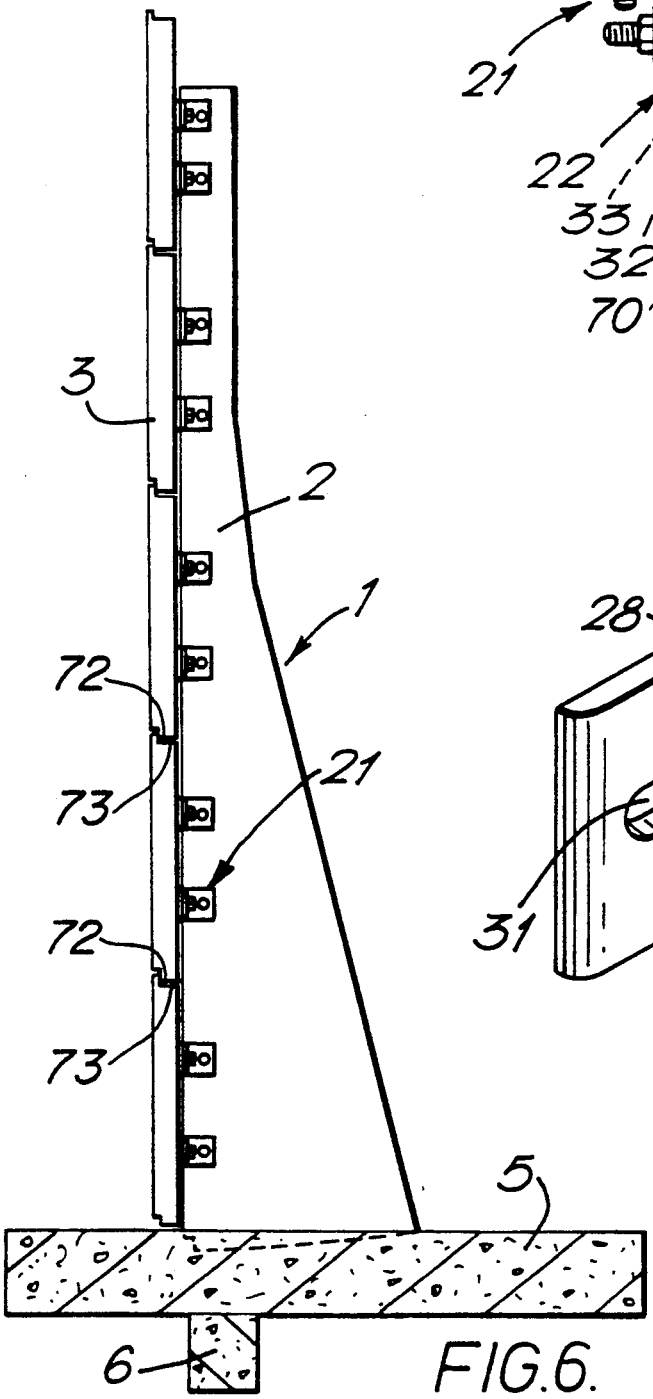
FIG. 6 is a view similar to that of FIG. 1 showing a structure having the alternative form of connections shown in FIG. 4.
Figure 7:
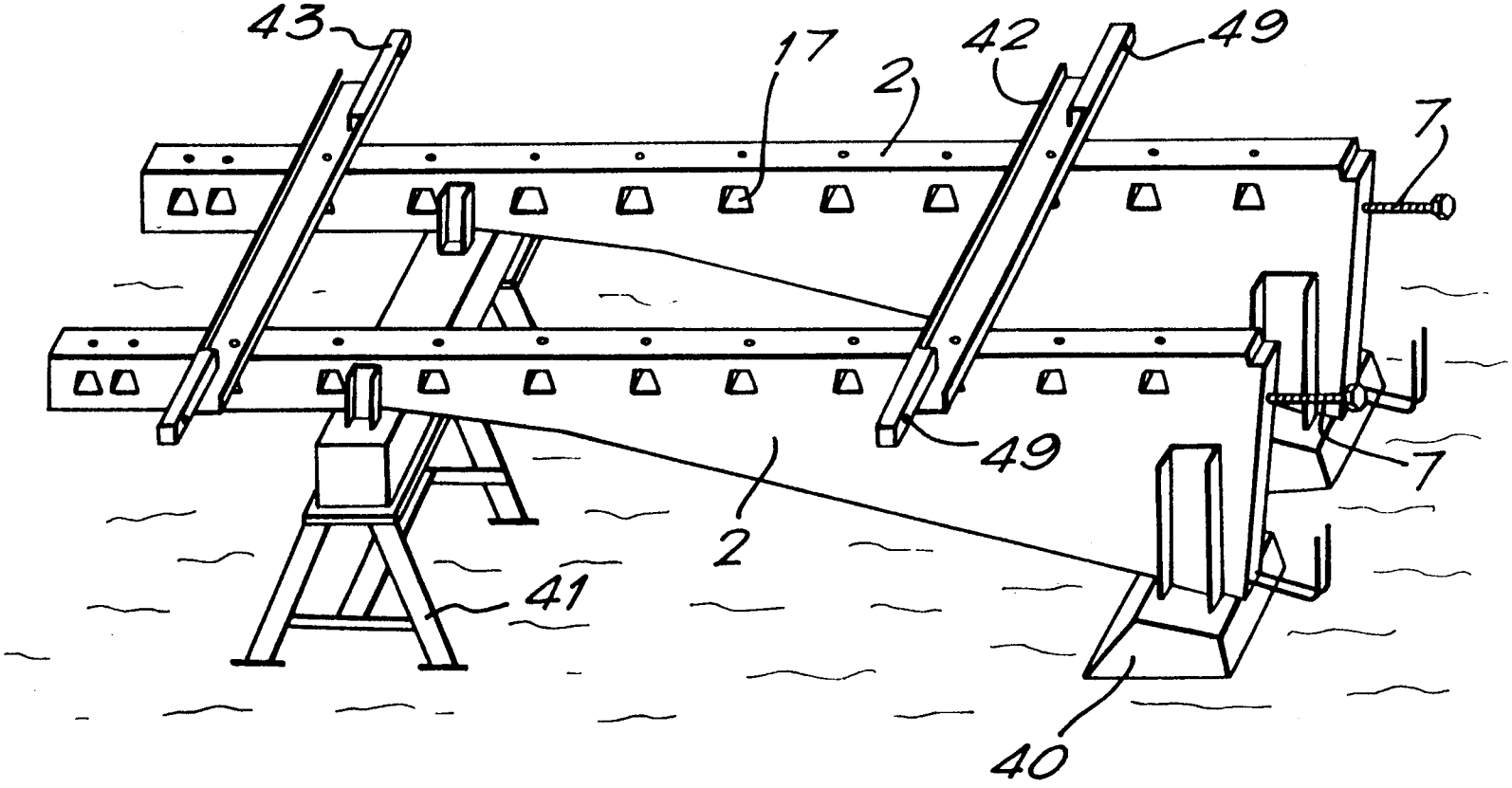
FIG. 7 shows a pair of counterforts arranged horizontally and secured together by lower and upper space beams.

FIG. 6 shows an assembled counterfort wall having bolted connections as shown in FIGS. 4 and 5. It will be noted that the upper and lower edges 72, 73 of the facing panels are keyed to provide interlocking engagement.

Figure 8:
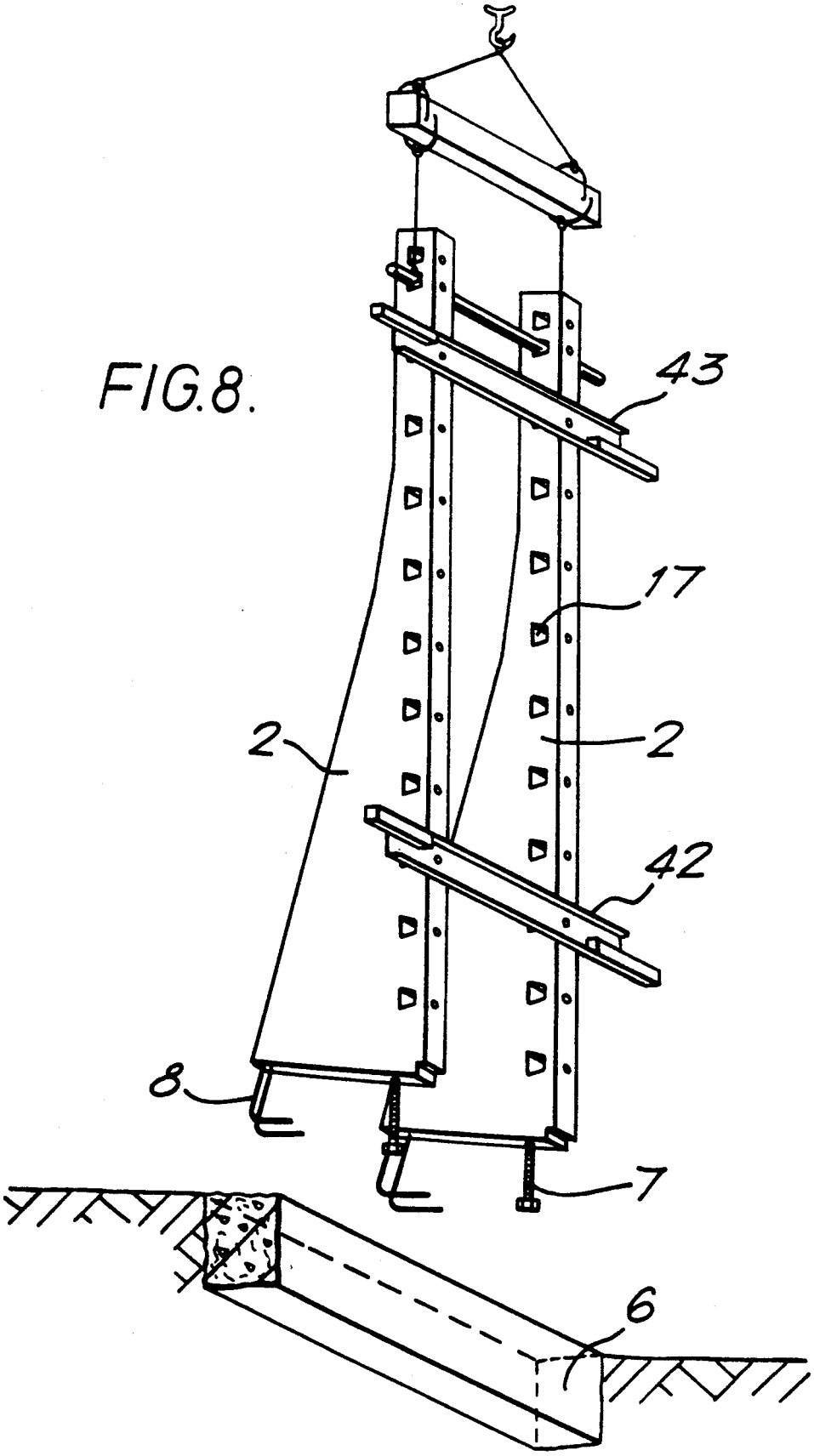
FIG. 8 is a perspective view of the counterforts of FIG. 7 being lifted into position on a shear key.
Figure 9:
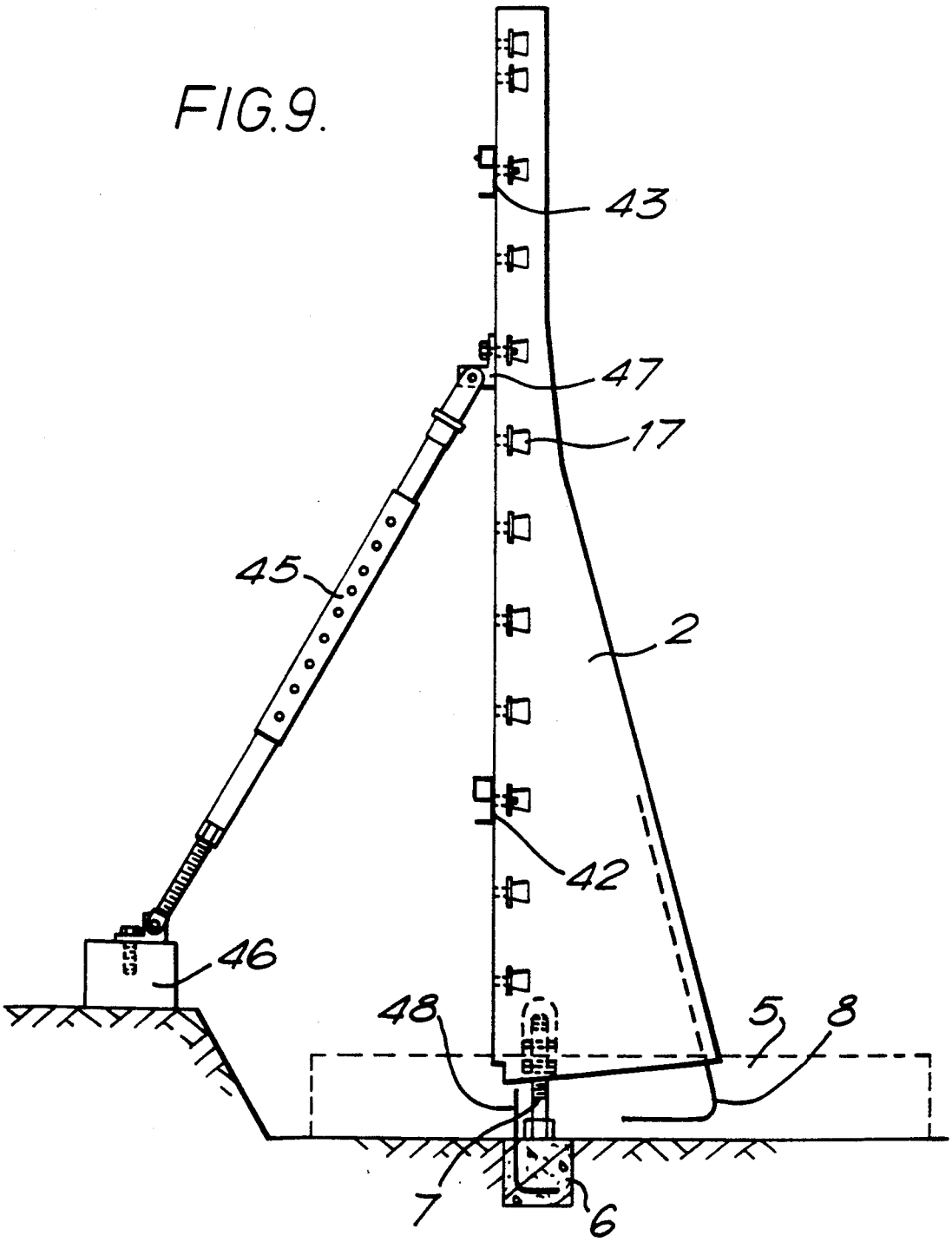
FIG. 9 is a side elevation of the counterforts located on the shear key.

FIGS. 7 to 10 show various stages during assembly and construction of the counterfort wall shown in FIG. 1. A pair of counterforts 2 are arranged on support tressels 40 and 41 and are connected together by lower and upper spacer beams 42 and 43. Each spacer beam is bolted to the pair of counterforts using the holes 15 which subsequently serve to form the bolted connections with respective facing panels. Referring to FIG. 8, after excavation is completed, a shear key 6 is poured in place. At this time the shear key serves as a levelling pad to support the pair of counterforts which are lifted up by a crane and placed with their erection bolts 7 on the shear key (see FIG. 9). Vertical adjustment of the counterforts is effected by a tilt-up brace 45 which extends between a ground support 46 and a bracket 47 bolted to the counterfort, again using one of the holes 15 which subsequently serves to form a connection with a facing panel. Once the pair of counterforts are correctly positioned the concrete footing 5 is cast to embed the erection bolts 7, reinforcement 48 projecting upwardly from the shear key and the reinforcement 8 projecting downwardly from the counterfort. The footing includes other reinforcement which is not shown for reasons of clarity.

Figure 10:
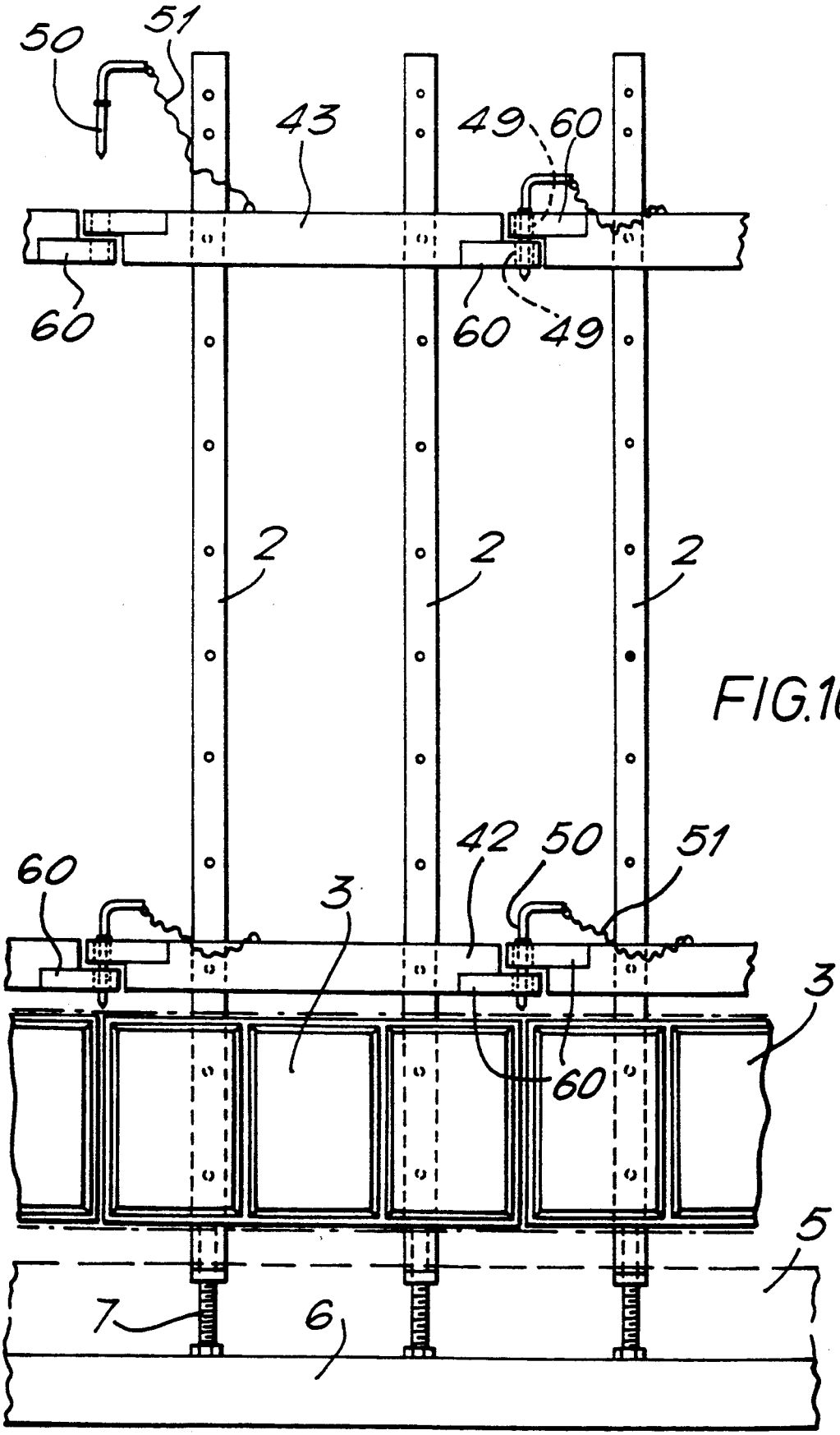
FIG. 10 is a front elevation view of the counterforts on the shear key with a first row of facing panels in position.

Referring to FIG. 10, an adjacent pair of counterforts is positioned next to those already installed and correct relative positioning is ensured by the locator means in the form of end pieces 60 provided at each end of the lower and upper spacer beams 42 and 43. Each end piece 60 has a vertical hole 49 and a lock pin 50 secured by a safety line 51 is inserted through the vertical hole 49 of adjacent end pieces 60 to keep them aligned.

When the cast-in-place concrete footing 5 has cured sufficiently, the first row of facing panels can be bolted to the counterforts and the lower spacer beam 42 may be removed. When one third of the panels are in place, the tilt-up brace 45 and upper spacer beam 43 can be removed. Once a row of facing panels is in position the wall may be back filled up to a level just below the upper edge of the panels so access to the structure for attaching the next row of panels is facilitated and there is no requirement for scaffolding or ladders.

It will therefore be seen that the counterfort wall and its construction method described above result in a number of advantages: relatively small and light weight prefabricated elements are delivered to the construction site; handling and maneuvering of the elements is easy; there is good access for placing the reinforcement pouring of the concrete footing; facing panels are installed at the level of previously placed back fill material, thereby eliminating the need for scaffolding; and the system can be used in fill areas as well as in cut sections.

While this invention has been illustrated and described in accordance with a preferred embodiment, it is recognized that variations and changes may be made and equivalents employed herein without departing from the invention as set forth in the claims.

What is claimed is:

1. A counterfort wall having a footing and prefabricated concrete elements which comprise at least one counterfort and a plurality of facing panels arranged above one another, said at least one counterfort being located rearwardly of said facing panels, each of the facing panels being secured to the at least one counterfort by at least one bolted connection, each of said bolted connections including a bolt cast in a respective facing panel and projecting rearwardly therefrom, and including connecting means having a hole formed therein for connecting the bolts to the at least one counterfort, the bolt extending through the hole in the connecting means, and fixing means being mounted on a free end of the bolt for substantially fixing the respective facing panels relative to the at least one counterfort, and resilient means positioned between each of said facing panels and the connecting means.

2. A counterfort wall as claimed in claim 1, wherein each of said facing panels is bolted to a pair of substantially parallel and laterally spaced counterforts.

3. A counterfort wall having a footing and prefabricated concrete elements which comprise at least one counterfort and a plurality of facing panels arranged above one another, said at least one counterfort being located rearwardly of said facing panels, each of the facing panels being secured to the at least one counterfort by at least one bolted connection, each of said bolted connections including a bolt cast in a respective facing panel and projecting rearwardly therefrom, and including connecting means having a hole formed therein for connecting the bolts to the at least one counterfort, the bolt extending through the hole in the connecting means, and fixing means being mounted on a free end of the bolt for substantially fixing the respective facing panels relative to the at least one counterfort, said connecting means comprising a front portion of the counterfort through which the hole is formed, the hole ending in a recess accessible from a side of the at least one counterfort to permit the fixing means to be mounted on the free end of the bolt.

4. A counterfort wall as claimed in claim 3, including resilient means positioned between each of said facing panels and the connecting means of said at lest one counterfort.

5. A counterfort wall as claimed in claim 3, wherein a metal plate is provided between the hole and the fixing means.

6. A counterfort wall as claimed in claim 3, wherein each of said facing panels is bolted to a pair of substantially parallel and laterally spaced counterforts.

7. A counterfort wall having a footing and prefabricated concrete elements which comprise at least one counterfort and a plurality of facing panels arranged above one another, said at least one counterfort being located rearwardly of said facing panels, each of the facing panels being secured to the at least one counterfort by at least one bolted connection, each of said bolted connections including a bolt cast in a respective facing panel and projecting rearwardly therefrom, and including connecting means having a hole formed therein for connecting the bolts to the at least one counterfort, the bolt extending through the hole in the connecting means, and fixing means being mounted on a free end of the bolt for substantially fixing the respective facing panels relative to the at least one counterfort, said connecting means comprising a plurality of metal connectors secured to the counterfort.

8. A counterfort wall as claimed in claim 7, wherein each metal connector has two portions substantially perpendicular to each other, one of said portions having said hole formed therein and being secured to one of the facing panels by one of said bolted connections, and the other of said portions being secured to said at least one counterfort by another bolted connection.

9. A counterfort wall as claimed in claim 8, wherein the hole of said one portion is a vertical slot for permitting vertical adjustment of each facing panel relative to the at least one counterfort, and wherein the other portion has a horizontal slot for permitting horizontal adjustment of each facing panel relative to the at least one counterfort.

10. A counterfort wall as claimed in claim 8, including resilient means positioned between at least some of the facing panels and one of the portions of the metal connector.

11. A counterfort wall as claimed in claim 7, including resilient means positioned between each of said facing panels and the connecting means of said at least one counterfort.

12. A counterfort wall as claimed in claim 7, wherein each of said facing panels is bolted to a pair of substantially parallel and laterally spaced counterforts.

* * * * *